United States Patent [19]

Sawada et al.

[11] 4,153,064

[45] May 8, 1979

[54] CIGARETTE FILTERS

[75] Inventors: Hideo Sawada; Junji Kawamoto, both of Sakai, Japan

[73] Assignee: Daicel Ltd., Osaka, Japan

[21] Appl. No.: 789,083

[22] Filed: Apr. 20, 1977

Related U.S. Application Data

[63] Continuation of Ser. No. 595,027, Jul. 11, 1975, abandoned, which is a continuation of Ser. No. 427,028, Dec. 13, 1973, abandoned.

[51] Int. Cl.[2] ..... A24D 1/00; A24B 15/00

[52] U.S. Cl. ..... 131/267; 106/183; 560/174

[58] Field of Search ..... 131/266–269; 260/483, 488; 106/183

[56] References Cited

U.S. PATENT DOCUMENTS

| | | | |
|---|---|---|---|
| 2,004,115 | 5/1932 | Izard | 260/488 |
| 2,008,720 | 5/1932 | Lawson | 260/483 |
| 3,424,172 | 1/1969 | Neurath | 131/267 |

FOREIGN PATENT DOCUMENTS

| | | | |
|---|---|---|---|
| 1101242 | 8/1968 | United Kingdom | 131/267 |

*Primary Examiner*—Robert W. Michell
*Assistant Examiner*—V. Millin
*Attorney, Agent, or Firm*—Blanchard, Flynn, Thiel, Boutell & Tanis

[57] ABSTRACT

Cigarette filters are prepared by blooming a tow of cellulose acetate fibers, adding or spraying onto the bloomed tow from 1 to 20% by weight (based on the weight of the cellulose acetate fibers) of a plasticizer composed solely of, or comprising as one ingredient, at least one levulinic acid ester, and gathering the thus-treated bloomed tow to form a cigarette filter rod.

16 Claims, No Drawings

CIGARETTE FILTERS

CROSS REFERENCE TO RELATED APPLICATIONS

This application is a continuation of Ser. No. 595,027, filed July 11, 1975, now abandoned, which in turn is a continuation of Ser. No. 427,028, filed Dec. 13, 1973, now abandoned.

BACKGROUND OF THE INVENTION

1. Field of the Invention

This invention relates to a process for preparing cigarette filters, for example, a cigarette filter as disclosed in Japanese Patent No. 278,071 (Patent Publication No. 5750/59). More particularly, this invention relates to a process for preparing a cigarette filter which comprises blooming a tow of cellulose acetate fibers, applying a plasticizer or the like onto the bloomed tow by spraying or other suitable means, and gathering the thus-treated bloomed tow to form a cigarette filter rod.

2. Description of the Prior Art

As preferred plasticizers for cellulose acetate fiber formed into cigarette filters, it is known to use glycerol triacetate, i.e., triacetin, and diacetates, dipropionates and dibutyrates of triethylene glycol, tetraethylene glycol and pentaethylene glycol. Since triacetin fails to give a sufficiently rapid curing rate, when triacetin is used as a plasticizer, it takes a long time to impart a prescribed hardness to the filter. Further, deformation readily occurs during the cutting operation and/or storage. Moreover, as is well known, the bitter characteristic of triacetin reduces the taste and flavor of the cigarettes. In the case of glycol esters such as triethylene glycol diacetate, it is known that the curing rate is rapid, the phenol filtering ratio is high and these characteristics scarcely change with the passage of time. However, the latter plasticizers dissolve the fibers excessively thereby to form voids by partial dissolution of the fibers. As a result, the pressure drop and the filtration efficiency are reduced. Further, it cannot be said that such plasticizers will provide a good taste or flavor.

As indicated above, a plasticizer to be used for preparing a cigarette filter composed of cellulose acetate fibers should have a curing rate which is neither too high nor too low, but rather is maintained at a suitable intermediate level, and such should provide good taste and flavor to smokers. Therefore, the suitability of plasticizers cannot be evaluated only from a consideration of a single property, such as its plasticizing activity to cellulose acetate fibers. Various studies have heretofore been made in this field, but no fully satisfactory results have been obtained yet.

SUMMARY OF THE INVENTION

We have discovered that levulinic acid esters possess unexpected improved properties as plasticizers for cellulose acetate cigarette filters, in comparison with previously used plasticizers. More specifically, we have found that such esters are effective to form better cigarette filters which do not significantly change the inherent taste and flavor of cigarettes. The plasticizers according to this invention can be cured within a very short time and they impart a sufficient hardness to a rod of cellulose acetate fibers within a very short time. Thus, they are effective plasticizers having a very high curing rate.

Accordingly, it is a primary object of this invention to provide a cigarette filter which does not harm the inherent taste and flavor of cigarettes. Further, levulinic acid esters have a good aroma and therefore, the taste and flavor of cigarettes can be improved by use of these esters as plasticizers for cellulose acetate cigarette filter rods.

Levulinic acid esters employed in this invention have the following formula $$CH_3-\overset{\overset{\displaystyle O}{\|}}{C}-CH_2-CH_2-\overset{\overset{\displaystyle O}{\|}}{C}-OR$$

in which R is ethyl, butyl propyl.

Among these esters, the ethyl ester is especially preferred, because it is excellent with respect to the curing rate, the taste and flavor given to a smoker and the absence of toxicity.

The levulinic acid esters, according to the invention, can also be used in combination with other conventional plasticizers, such as triacetin, and diacetates, dipropionates and dibutyrates of triethylene glycol, tetraethylene glycol and pentaethylene glycol, to increase the curing rate and to improve the taste and flavor. Further, because of their high plasticizing effect, satisfactory results are obtained when these esters are used in amounts less than the customary amounts of the conventional plasticizers, such as triacetin and triethylene glycol diacetate. Thus, the levulinic acid esters are used in an amount of 1 to 20% by weight, especially 3 to 10% by weight, based on the weight of cellulose acetate fibers treated. (All of the percentage values given hereinafter are on the weight basis unless otherwise indicated.)

In this invention, cellulose acetate fibers are usually employed in the form of a tow prepared by gathering 3000 to 100,000 continuous filaments each having a size of 1 to 16 deniers. It is preferred that 10 to 30 uniform crimps are given to the tow per 25 mm of the tow length.

Any method suitable for applying the plasticizer uniformly to cellulose acetate fibers can be employed in this invention, without limitation. For example, the plasticizer can be applied to both the upper and lower surfaces of the tow by a known method using a spray gun or a wick. If the amount of the plasticizer is too large, the cellulose acetate fibers are so thoroughly dissolved that dopes are formed. Accordingly, a substantially uniform amount of the plasticizer is applied to the tow. If the amount of the plasticizer applied is too small, a sufficient bonding of the fibers is not obtained. In view of the foregoing, in this invention it is important that the plasticizer is distributed uniformly in the interior of the tow band.

In this invention, the preparation of cigarette filters from tows incorporated with plasticizer can be carried out by methods now industrially practiced for the preparation of cigarette filters of cellulose acetate fibers.

The cigarette filter obtained by the above-described method of this invention is characterized by the facts that the inherent properties of the cellulose acetate fibers are not lost and a very high curing rate can be obtained. Further, various studies have been made on the biochemical activity of levulinic acid esters and it has been reported that they have no toxic effects. Accordingly, this invention has significant industrial value.

The method of this invention will now further be described by reference to the following illustrative Examples. In the Example, the rod hardness was determined by the following method. A load of 300 g was imposed on a horizontally placed sample rod by means of a disc having a diameter of 12 mm, for 10 seconds. The depth of the indentation formed by the load was measured by taking 0.1 millimeter as one whole unit and measuring the depth of the indentation down to one decimal place of that unit. A lower value indicates that the sample is harder and a higher value indicates that the sample is softer.

The pressure drop is expressed in terms of the resistance pressure in a water column height (mm) obtained when air was passed through a test filter rod of a length of 102 mm at a rate of 17.5 ml/sec.

EXAMPLES 1 TO 5 AND COMPARATIVE EXAMPLES 1, 2 AND 3

A mechanically crimped cellulose acetate fiber tow having an individual filament denier of 3.5 and a total denier of 43000 was bloomed and a prescribed amount of a levulinic acid ester was applied at a uniform rate to the bloomed tow. Then, the tow was fed to a tow-processing machine and was formed into a rod having a circumference of 24.7 mm by wrapping a plug wrap paper thereon. Then, it was cut into test pieces each of a length of 102 mm. The rod hardness was measured when it had been allowed to stand at room temperature for 1 hour and 24 hours, respectively, after completion of the filter making. The test results are shown in Table 1.

The above procedures were repeated in the same manner, but employing triacetin and triethylene glycol diacetate as the plasticizer. The hardness of the thus-prepared rods and also a rod wrapped in the same manner as above without using any plasticizer, was determined after the rods had been allowed to stand still at room temperature for 1 and 24 hours. These results are shown in Table 1 as Comparative Examples 1, 2 AND 3.

Table 1

| Example No. | Plasticizer Kind | Plasticizer % by weight | Rod weight (g/rod) | Pressure drop (mm $H_2O$) | Hardness = one unit 0.1 mm after one hour | Hardness = one unit 0.1 mm after 24 hours |
|---|---|---|---|---|---|---|
| 1 | butyl levulinate | 9.6 | 0.754 | 269 | 7.5 | 7.1 |
| 2 | " | 3.1 | 0.733 | 285 | 8.2 | 8.1 |
| 3 | ethyl levulinate | 6.4 | 0.756 | 266 | 7.0 | 6.9 |
| 4 | " | 5.2 | 0.747 | 245 | 7.1 | 7.0 |
| 5 | 2-ethylhexyl levulinate | 7.2 | 0.752 | 258 | 9.5 | 8.3 |
| Comparative Example 1 | none | 0 | 0.677 | 247 | 12.1 | 12.7 |
| Comparative Example 2 | triacetin | 8.0 | 0.735 | 259 | 10.5 | 8.3 |
| Comparative Example 3 | triethylene glycol diacetate | 6.9 | 0.743 | 253 | 11.5 | 10.8 |

From the results shown in Table 1, it will readily be understood that the time necessary for the rod to reach an acceptable hardness (less than 10 units) is 24 hours in the case of triacetin and triethylene glycol diacetate, whereas in the case of the levulinic acid esters a curing time 1 hour gives an acceptable hardness. It is also seen that a sufficient effect can be obtained with use of a smaller amount of the plasticizer in the case of levulinic acid esters.

EXAMPLES 6 AND 7

The same procedures as described in the above Examples were repeated in the same manner, but employing equal amount mixtures of ethyl levulinate and triacetin or triethylene-glycol diacetate as the plasticizer. The results are shown in Table 2 as Examples 6 and 7.

Table 2

| Example No. | Plasticizer Kind | Plasticizer % by weight | Rod weight (g/rod) | Pressure drop (mm $H_2O$) | Hardness = one unit 0.1 mm after one hour | Hardness = one unit 0.1 mm after 24 hours |
|---|---|---|---|---|---|---|
| 5 | equal amount mixture of triacetin and ethyl levulinate | 6.4 | 0.751 | 267 | 7.7 | 7.3 |
| 7 | equal amount mixture of triethylene glycol diacetate and ethyl levulinate | 6.5 | 0.748 | 258 | 7.5 | 7.3 |

The embodiments of the invention is which an exclusive property or privilege is claimed are defined as follows:

1. A cigarette filter comprising a rod of cellulose acetate fibers impregnated with from 1 to 20 percent by weight, based on the weight of said cellulose acetate fibers, of ethyl levulinate, said cigarette filter having a hardness of less than 10 units after curing at room temperature for one hour, wherein hardness is measured by applying a load of 300 g on a sample rod by means of a disc having a diameter of 12 mm for 10 seconds and measuring the depth of the indentation thereby formed in the sample rod, and wherein a hardness unit is equal to 0.1 millimeter.

2. A cigarette filter according to claim 1, in which the amount of said ethyl levulinate is from 3 to 10 percent by weight, based on the weight of said cellulose acetate fibers.

3. A cigarette filter according to claim 1, in which the rod contains from 3000 to 100000 cellulose acetate filaments each having a size of 1 to 16 denier.

4. A cigarette filter according to claim 3, in which the cellulose acetate filaments have from 10 to 30 crimps per 25 mm of filament length.

5. A cigarette filter comprising a rod of cellulose acetate fibers impregnated with from 1 to 20 percent by weight, based on the weight of said cellulose acetate fibers, of methyl levulinate, said cigarette filter having a hardness of less than 10 units after curing at room temperature for one hour, wherein hardness is measured by applying a load of 300 g on a sample rod by means of a disc having a diameter of 12 mm for 10 seconds and measuring the depth of the indentation thereby formed in the sample rod, and wherein a hardness unit is equal to 0.1 millimeter.

6. A cigarette filter according to claim 5, in which the amount of said methyl levulinate is from 3 to 10 percent by weight, based on the weight of said cellulose acetate fibers.

7. A cigarette filter according to claim 5, in which the rod contains from 3000 to 100000 cellulose acetate filaments each having a size of 1 to 16 denier.

8. A cigarette filter according to claim 7, in which the cellulose acetate filaments have from 10 to 30 crimps per 25 mm of filament length.

9. A cigarette filter comprising a rod of cellulose acetate fibers impregnated with from 1 to 20 percent by weight, based on the weight of said cellulose acetate fibers, of butyl levulinate, said cigarette filter having a hardness of less than 10 units after curing at room temperature for one hour, wherein hardness is measured by applying a load of 300 g on a sample rod by means of a disc having a diameter of 12 mm for 10 seconds and measuring the depth of the indentation thereby formed in the sample rod, and wherein a hardness unit is equal to 0.1 millimeter.

10. A cigarette filter according to claim 9, in which the amount of said butyl levulinate is from 3 to 10 percent by weight, based on the weight of said cellulose acetate fibers.

11. A cigarette filter according to claim 9, in which the rod contains from 3000 to 100000 cellullose acetate filaments each having a size of 1 to 16 denier.

12. A cigarette filter according to claim 11, in which the cellulose acetate filaments have from 10 to 30 crimps per 25 mm of filament length.

13. A cigarette filter comprising a rod of cellulose acetate fibers impregnated with from 1 to 20 percent by weight, based on the weight of said cellulose acetate fibers, of propyl levulinate, said cigarette filter having a hardness of less than 10 units after curing at room temperature for one hour, wherein hardness is measured by applying a load of 300 g on a sample rod by means of a disc having a diameter of 12 mm for 10 seconds and measuring the depth of the indentation thereby formed in the sample rod, and wherein a hardness unit is equal to 0.1 millimeter.

14. A cigarette filter according to claim 13, in which the amount of said propyl levulinate is from 3 to 10 percent by weight, based on the weight of said cellulose acetate fibers.

15. A cigarette filter according to claim 13, in which the rod contains from 3000 to 100000 cellulose acetate filaments each having a size of 1 to 16 denier.

16. A cigarette fitler according to claim 15, in which the cellulose acetate filaments have from 10 to 30 crimps per 25 mm of filament length.

* * * * *